United States Patent [19]

Tolson

[11] Patent Number: 5,062,217

[45] Date of Patent: Nov. 5, 1991

[54] SELECTIVE SEQUENTIAL SHRINK APPARATUS AND PROCESS

[75] Inventor: Sidney S. Tolson, Scotland Neck, N.C.

[73] Assignee: Ossid Corporation, Rocky Mount, N.C.

[21] Appl. No.: 611,530

[22] Filed: Nov. 13, 1990

[51] Int. Cl.[5] ..... F26B 3/00

[52] U.S. Cl. ..... 34/22; 34/216; 34/217; 34/44

[58] Field of Search ..... 34/209, 210, 215, 216, 34/217, 225, 229, 232, 233, 236, 44, 48, 52, 54, 30, 22

[56] References Cited

U.S. PATENT DOCUMENTS

| | | | |
|---|---|---|---|
| 2,906,627 | 9/1959 | Payton et al. | 34/216 |
| 3,222,800 | 12/1965 | Siegel et al. | 34/217 |
| 3,309,835 | 3/1967 | Peppler | 53/30 |
| 3,312,811 | 4/1967 | Shanklin | 34/216 |
| 3,349,502 | 8/1964 | Kiefer | 34/216 |
| 3,534,393 | 10/1970 | Bickham et al. | 34/216 |
| 3,616,546 | 11/1971 | Billingsley et al. | 34/217 |
| 3,727,324 | 4/1973 | Melgaard | 34/216 |
| 3,744,146 | 7/1973 | Nichols | 34/216 |
| 3,866,331 | 2/1975 | Evans Jr. | 34/216 |
| 3,869,844 | 3/1975 | Edouard | 34/216 |
| 3,889,394 | 6/1975 | Fischer | 34/216 |
| 4,676,006 | 6/1987 | Tolson | 34/217 |

*Primary Examiner*—Henry A. Bennet
*Assistant Examiner*—Denise L. F. Gromada
*Attorney, Agent, or Firm*—Olive & Olive

[57] ABSTRACT

A shrink tunnel apparatus and method for the processing of packages wrapped in heat shrinkable film directs heated air streams sequentially to the package, first from below, then from both sides simultaneously and finally from above. Simultaneous with the directed heated air streams, the balance of the film is exposed to warm air effecting a differential shrink. The packages are transported through the shrink tunnel by a conveyor utilizing spaced apart rotating rollers.

25 Claims, 5 Drawing Sheets

SELECTIVE SEQUENTIAL SHRINK APPARATUS AND PROCESS

BACKGROUND OF THE INVENTION

1. Field of the Invention

This invention pertains to the field of packaging of products in heat shrinkable film, and more particularly to the packaging of meat products in high speed production operations.

2. Background of the Invention

A significant quantity of meat products, and particularly poultry products are packaged in heat shrinkable film which is shrunk around the product prior to shipping to a market. The product, such as poultry, is typically supported in a tray which is also included within the film wrapped enclosure.

There are a number of methods of wrapping the tray and product in automated processes. The more prevalent methods may be referred to as the single sheet over-wrap method, the double sheet sandwich method and the single sheet tubular wrap method and which is also called a pillow pack. In the single sheet over-wrap method, a single rectangular sheet of wrapping film is placed over the product and tray, the film is then wrapped around all four sides, and tucked under the bottom for heat sealing. In the double sheet sandwich method the product is positioned between two continuous sheets of film and the four sides are sealed with heating means after which the film is cut behind the trailing end. In the single sheet tubular wrap method, the product and tray are positioned beneath a wide, continuous film, and the two edges are brought down around and under the package, and are sealed together along the center line of the bottom of the tray to form a tube after which the tube is heat sealed, typically by bar sealers, ahead of and behind the package and separated from the rest of the film. The resultant film package is somewhat larger then the product tray and fits loosely prior to being shrunk.

The typical shallow tray of the type to which the invention pertains is molded of a plastic material, has upwardly and outwardly angled side walls and a peripheral flange or lip.

In the case of the double sheet sandwich and single sheet tubular wrap methods, the sealed edges are typically of the order of ⅜" in width and project laterally outward in the vicinity of the tray flanges or lips. The seal width of approximately ⅜" is useful so as to aid in the protection of the meat product by maintaining a hermetic seal. These edges normally occur at a height approximately equal to or higher than that of the tray flanges. As can be readily appreciated, if these sealed edges were to remain in that position and orientation to the point of consumer presentation at the market, the overall appearance of the package would be less than acceptable.

The more desirable position for the sealed edges after shrinking is one that is relatively unobtrusive. Such a position would be below and inside of the periphery of the tray flange. This would make the finished edge unnoticable so that attention of the customer would remain on the product.

The shrinkable film is responsive to heat from a variety of media, such as radiant heat transfer, heated air streams or heated water. The radiant transfer method tends to be slow and less than optimally efficient in a production operation. The heated water method transfers heat effectively, but may require subsequent drying and other clean up. Therefore, the heated air method is generally preferred as being reasonably quick and efficient for the typical relatively high speed production, e.g. forty or more packages per minute.

In the body of prior art on shrink tunnels, U.S. Pat. No. 3,349,502 to Kiefer teaches an apparatus intended to solve the problem addressed by the present invention, but by a different method. As illustrated by FIGS. 1, 2, 4 and 5 in the Kiefer patent, air nozzles direct the heated air generally at the bottom of the wrapped tray, relying on the tunnel enclosure to trap the heat required to shrink the sides and upper surface of the film. By more specific and sequentially applied directed hot air streams at plural stations combined with thermally insulative, rotating conveyor rollers, the present invention improves on the prior technology and creates a better appearing package in a more efficient production process.

Therefore, an object of the present invention is to create a package of poultry or other product which is wrapped in a heat shrinkable film and sealed hermetically at the edges and in which the sealed edges are finished in a position beneath and within the periphery of the tray flanges.

A further object of the present invention is to create such a package in a high speed production operation.

An additional object of the present invention is to create a finished package in which the film is tight and substantially wrinkle free.

Additional objects and benefits will become apparent as the description details the invention.

SUMMARY OF THE INVENTION

The invention is directed to a novel shrink tunnel apparatus and method for the heat shrinking of film wrapped packages of poultry or the like in a high speed processing operation by sequentially directing spaced apart heated air streams at selected sites on the film wrapped package as the packages move past those air streams. The directed heated air stream sequence shrinks the film ends and the bottom first, lower sides second, and top surface last. While each selected site is undergoing maximum shrink effect, the balance of the film is exposed to warm ambient air in the tunnel and undergoing moderate shrinkage. Thus, the invention achieves selected area as well as differential shrinking.

The packages are transported through the tunnel and past the second heated air nozzles by a conveyor having spaced apart, rotating rollers which allow complete heated air stream contact with the tray bottom surface.

DESCRIPTION OF THE INVENTION

For purposes of illustration, it is assumed that the wrapped product being processed was wrapped in heat shrinkable film by the previously referred to single sheet tubular wrap method. A poultry packaging machine which makes this type of package, by way of example, is the OSSID 1000 VAC/MAP sold by Ossid Corporation, 4000 College Road, Rocky Mount, N.C.

Figure 1:
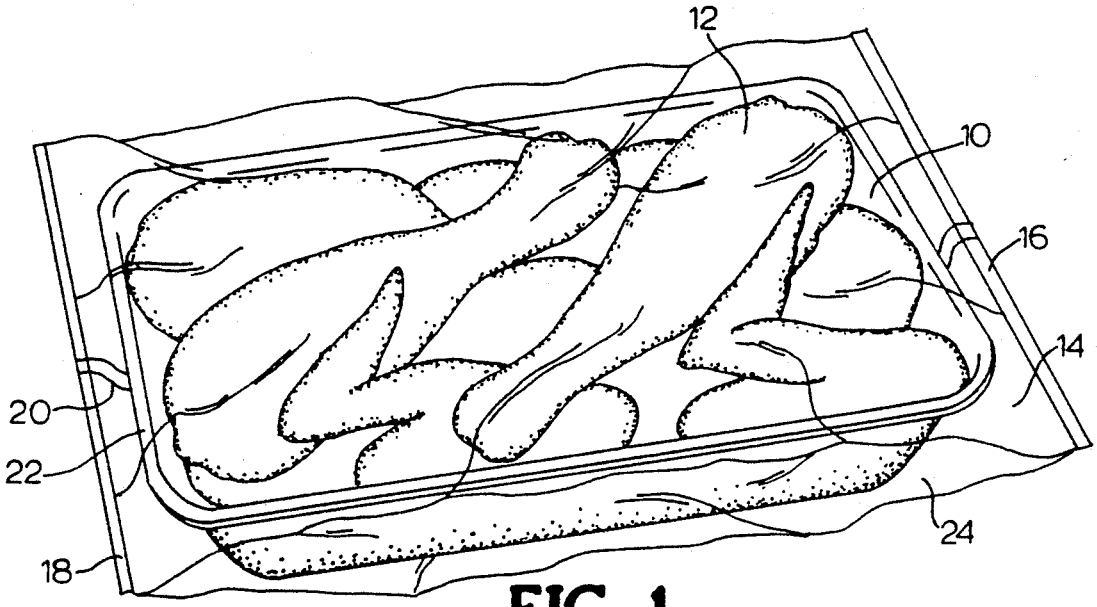
FIG. 1 is a perspective view of a wrapped product-filled tray sealed within a heat shrinkable film prior to being passed through the shrink tunnel of the invention and illustrating the end seals extending outwardly from the tray flanges at each end of the tray.
Figure 2:
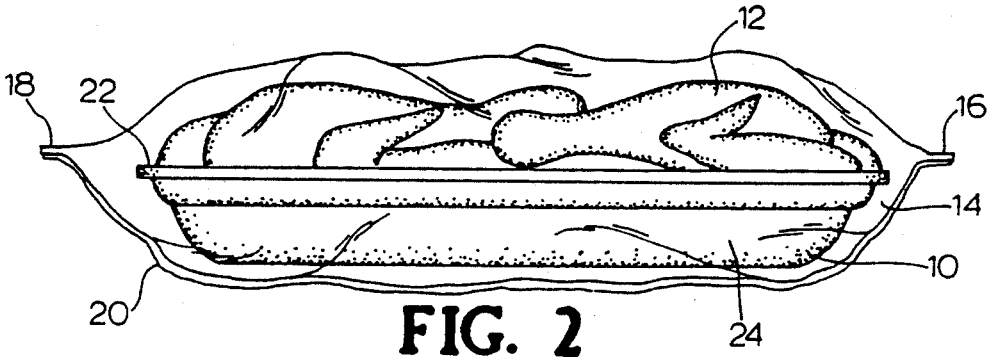
FIG. 2 is a side view of the same tray as depicted in FIG. 1, illustrating the position of the extending flanges prior to passing through the shrink tunnel of the invention.

Referring to FIGS. 1 and 2, a product 12 is placed in a shallow rectangular supporting tray 10, the tray 10 and product 12 being enclosed in a loosely fitting sealed film 14 of a heat shrinkable material. Supporting tray 10 is typically made of paperboard or of plastic foam, but may be of any suitable material and is configured with a peripherally protruding stiffening flange or lip 22. Heat shrinkable film 14 may be either a uniaxial or biaxial oriented shrinking type, however, the biaxial oriented film is considered preferable. The loosely fitting film 14 is sealed with a leading end seal 16, a trailing end seal 18 and a bottom center seal 20. Each of the seals 16, 18 and 20 are formed through the application of heat by a bar sealer or other acceptable sealing means and are of the order of approximately ⅜ inch in width, this width being desirable to ensure a thorough seal against atmospheric intrusion and aiding in the retention of a modified atmosphere for protection against degradation. Lower side portions 24 of shrinkable film 14 are similarly loosely fitting about tray 10.

The normal result of sealing a filled tray such as tray 10 is that the seals 16 and 18 at either end are disposed at a height equal to or higher than that of the tray flange 22. Sealed edges 16 and 18, as shown in side projection in FIG. 2 protrude horizontally from the ends of film enclosure 14 in an unattractive fashion. For merchandising appeal, the producer will typically place product 12 in tray 10 so that a maximum quantity of product 12 will be visible above the flange height of tray 10.

Figure 3:
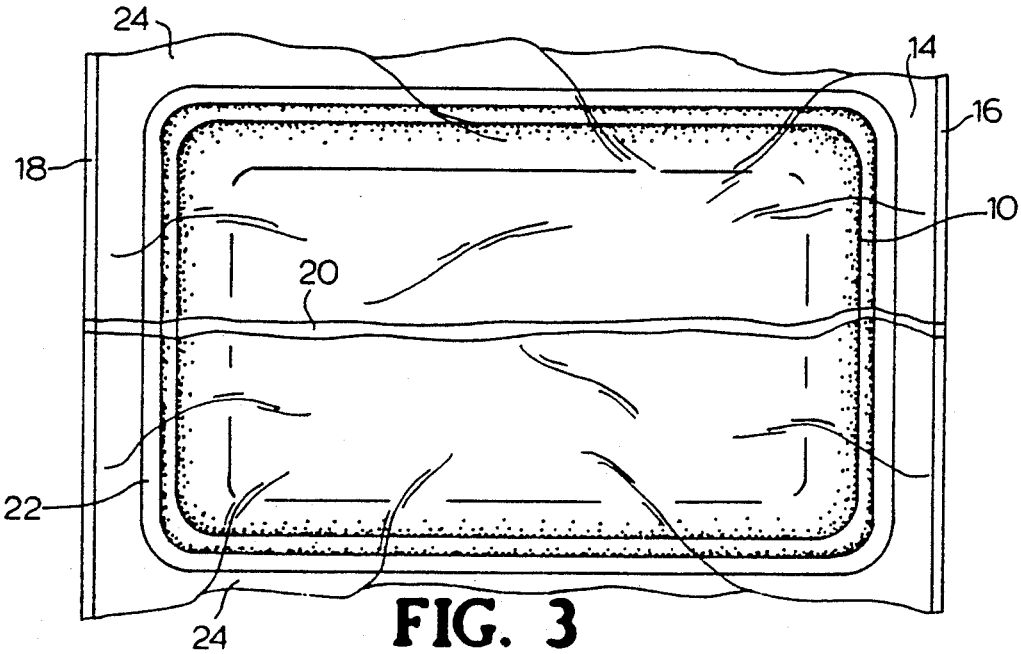
FIG. 3 is a bottom view of the same tray as depicted in FIG. 1, illustrating the bottom central seam running longitudinally along the bottom of the tray.

FIG. 3 shows the bottom of tray 10 with the center bottom seal 20 passing across the approximate center of tray 10 which is wrapped in the loosely fitting sealed film 14. At this point in the packaging cycle, the two end seals 16 and 18 are formed and are illustrated projecting beyond the length of flange 22 in an unattractive fashion.

Having described the typical product-tray-film assembly prior to being heat shrunk, the description next refers to the unique tunnel construction of the invention and manner of shrinking the film.

Figure 4:
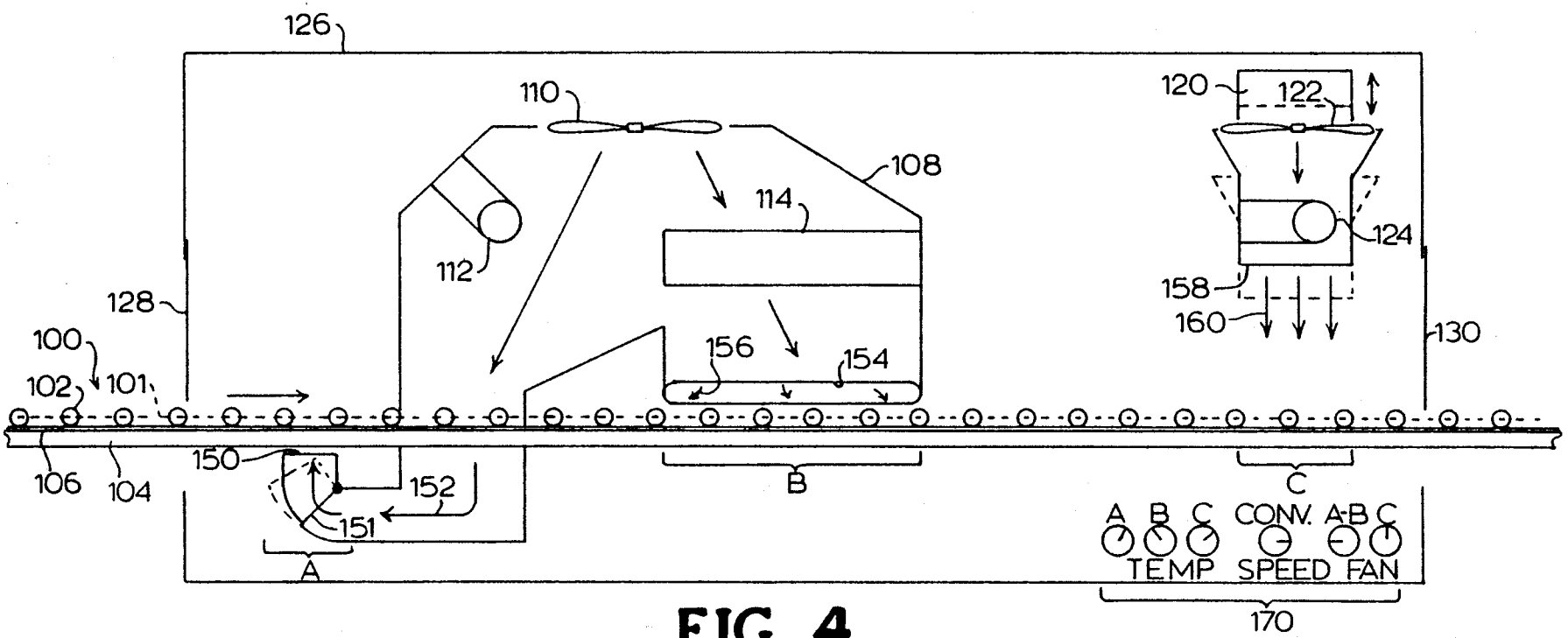
FIG. 4 is a schematic side view of the shrink tunnel of the invention without wrapped product, indicating operative sequential shrink stations A, B and C.
Figure 15:
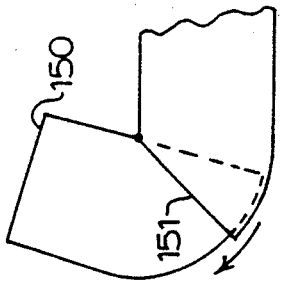
FIG. 15 shows an enlarged side view of top nozzle 150 illustrating the angular adjustment in the extended position.
Figure 14:
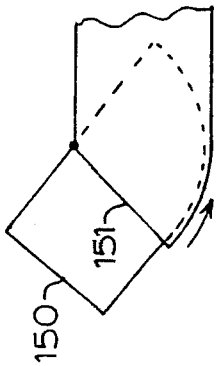
FIG. 14 shows an enlarged side view of top nozzle 150 illustrating the angular adjustment in the contracted position.

In FIG. 4 the shrink tunnel 126 of the invention has an inlet covering 128 and an outlet covering 130, each opening having a flexible insulative covering which permits product to pass, typically a curtain of narrow, overlapping strips of fabric or plastic. A product carrying conveyor 100 travels along a path from tunnel inlet covering 128 toward tunnel outlet covering 130. Within shrink tunnel 126 is disposed a hot air generating and directing plenum 108 having a bottom communicating single nozzle 150 positioned to direct a heated air stream 152 upwardly at the underside of a product moving along conveyor 100 and a pair of side nozzles 154 positioned opposite and facing one another to direct heated air streams 156 horizontally at both lower sides 24 of the film covering of wrapped tray 10. Hot air nozzles 150 and 154 are configured as elongate slots to control and direct the flow of air at specific segments of the shrink film 14 around tray 10 so as to obtain the objectives of the invention of selectively shrinking film 14. Bottom nozzle 150 may be adapted by hinge 151 to enable an angular adjustment in the direction of the air flow of up to about 45° either side of vertical as shown in greater detail in FIGS. 14 and 15. Side nozzles 154 may be adapted to enable an angular adjustment of up to 45° in either direction and additionally a linear change of up to 1" in the proximity of tray 10 as illustrated more fully in FIG. 13. The long axis of the rectangular shaped elongate nozzle 150 is typically oriented perpendicular to the path of conveyor 100, and the long axis of the rectangular shaped elongate nozzles 154 are typically oriented parallel to said path, all nozzles 150 and 154 direct air streams perpendicular to the conveyor path.

Plenum 108 includes an air moving means 110 adapted to move an adequate volume of air past heater 112 which heats air stream 152 as it continues to bottom nozzle 150. Air moving means 110 simultaneously moves an adequate volume of air past heater 114 which is disposed in air stream 156 and continues to the pair of side nozzles 154. Heaters 112 and 114 are deemed to be electrical heaters for purposes of illustration but may be of any convenient type such as electrical or gas-fired and may be commonly or individually controlled, depending upon the requirements of the system.

Also within tunnel 126 is housing 120, which has a capability to be adjusted in vertical height to adapt to the height and other properties of the product being processed. Housing 120 has an air moving means 122 adapted to move an adequate volume of air past heater 124 which is disposed in air stream 160 to direct heated air downwardly through nozzle 158 at the upper surface of the heat shrinkable film 14. Nozzle 158 is preferably rectangular but may be of other shape, configured such that the width of the air stream 160 is sufficient to cover essentially the entire film wrapped tray 10 and the length of the air stream 160 is sufficient to expose the upper surface of film 14 to heated air stream 160 for a time adequate to achieve the desired results of tightening and removing wrinkles. The long axis of the rectangular shaped nozzle 158 is shown oriented perpendicular to the path of conveyor 100 while the short axis of the nozzle 158 is shown oriented parallel to such path. While the illustrated embodiment depicts nozzles 150, 154 and 158 as elongate and rectangular aperatures, alternate nozzle configurations capable of accomplishing the principles of the present invention are considered within its teaching.

Controls 170 for regulating the temperature, air flow and conveyor speed are utilized and may be of any convenient type. Means within shrink tunnel 126 are arranged to recirculate the heated air, thus conserving energy and optimizing efficiency and speed.

Conveying device 100 has a series of substantially cylindrical rollers 102 which are made of a material which is a good thermal insulator to minimize overheating or sticking of film, and has a high heat tolerance. Rollers 102 are mounted on any convenient driving means capable of permitting roller rotation, such as a chain 101 or the like and are spaced apart for maximum flow of heated air directed upwards from elongate air nozzle 150. Rollers 102 are positioned so as to engage a surface of one or more elongate, stiff support friction members 104 mounted parallel and adjacent the path of rollers 102 in their travel to and through shrink tunnel 126 and having a frictional property to generate a rolling action of rollers 102 in a direction to move trays 10 at a velocity greater than that of conveyor 100 as the rollers 102 pass in contact with the frictional member. A feature of the invention is that while chain 101 moves rollers 102 in a linear direction, frictional member 104 causes rollers 102 to rotate such that the rolling tangential contact of rollers 102 and tray 10 will propel tray 10 at a speed greater than the speed of chain 101. This action assures the exposure of the entire bottom surface of tray 10 to upwardly directed heated air stream 152 resulting in improved shrink uniformity and elimination of roller marks. Member 104 may be a single solid unit or may be a relatively rigid substrate member 104 covered by a relatively thin surface material 106 which contributes the frictional characteristics, the surface material 106 and member 104 being tolerant of high temperatures.

By employing the novel means of frictionally rotating conveyor rollers 102, a higher temperature heated air stream may be utilized and a greater productivity rate achieved. Rollers 102, which are made of a material which will not conduct heat readily to the film and which are spaced apart to permit maximum air flow, contribute significantly to achieving the objectives of speed and efficiency of production.

Heat shrinkable film is susceptible to shrinking upon the application of heat; usual types in the wrapping industry respond to temperatures of between 122°-177° C. (250°-350° F.). Higher temperatures tend to reduce the time for shirnkage but could result in burning, melting or embrittlement. Speed may also be enhanced by applying greater quantities of heat at the desirable temperature level. This may be accomplished by increased volume of the heat transfer medium impinging upon the film at the correct temperature.

In the principle of the present invention, the product speed of travel, the heat shrink temperature and the positioning and direction of the heated air stream are all significant at speeds of 40-50 packages per minute. A given package is exposed within the 4 foot long shrink tunnel for approximately 3 seconds. Each operating station of bottom shrink (A), sides shrink (B) and top shrink (C) has less than 1 second to achieve the result.

By directing a large volume of air at the proper temperature at a particular segment of the film, shrinking in that position is rapidly accomplished while overall exposure to a hot atmosphere without directed heated air streams does a more gradual, overall shrinking. A differential shrink between the areas to which the heated air streams are directed and the generally heat exposed areas is accomplished.

The thermal flow cycle in the shrink tunnel 126 of the present invention is energized by air moving means 110 and heaters 112 and 114. Air moving means 110 draws warm ambient tunnel air and drives it past heaters 112 and 114 where the air is heated to maximum cycle temperature. The heated air stream is directed within plenum 108 to nozzle 150 for upward air stream and nozzles 154 for lateral air stream of heated air at slightly below maximum cycle temperature, at which temperature the air streams 152 and 156 impinge wrapped tray 10 imparting maximum shrink effect at the selected sites of the sequential shrinking process.

A cycle of temperature occurs as the air circulates through the operating system. Beginning with the air moving means 110, the air is relatively cool and it is pushed toward heaters 112 and 114, picking up heat to achieve the maximum cycle temperature. The heated air streams 152 and 156 continue to nozzles 150 and 154 where the air streams are directed at and impinge upon the selected sections of film wrap 14 over tray 10, losing a portion of its heat thereto. The air continues past the film wrapped package into the open areas of the shrink tunnel 126, losing more heat to the non-directed sections of film 14 and to the tunnel components as it circulates within the tunnel and then returns to the starting point at air moving device 110. The air stream, having lost a degree of heat in the transfer to the shrink film at the nozzle impingement points, continues to flow past package 10 into the ambient shrink tunnel atmosphere where the temperature is slightly cooler in comparison to the maximum cycle temperature. A similar thermal flow cycle occurs in housing 120 of the shrink tunnel 126.

This thermal cycle creates a two stage shrink action on the film 14, the two stages occuring in different locations on the film 14 at the same time. Stage one is at maximum cycle temperature and occurs where heated air stream 152 and 156 impinges shrink film 14 at specific target sites. Stage two is at the slightly cooler temperature of the oven ambient air. While the difference between the two temperatures is not typically great, the effect of impinging a specific area with pressurized air at maximum temperature is significantly more shrinkage than that occuring in areas contacted by lower pressure air at a slightly lower temperature. This differential shrink effect is magnified in respect to the processing time frame of less than 1 second per package.

This unique apparatus and method creates the above described differential shrink at a series of operative stations, resulting in a completed shrink wrapping which is commercially attractive, protects the product from atmosphere exposure, and is efficiently processed.

Figure 5:
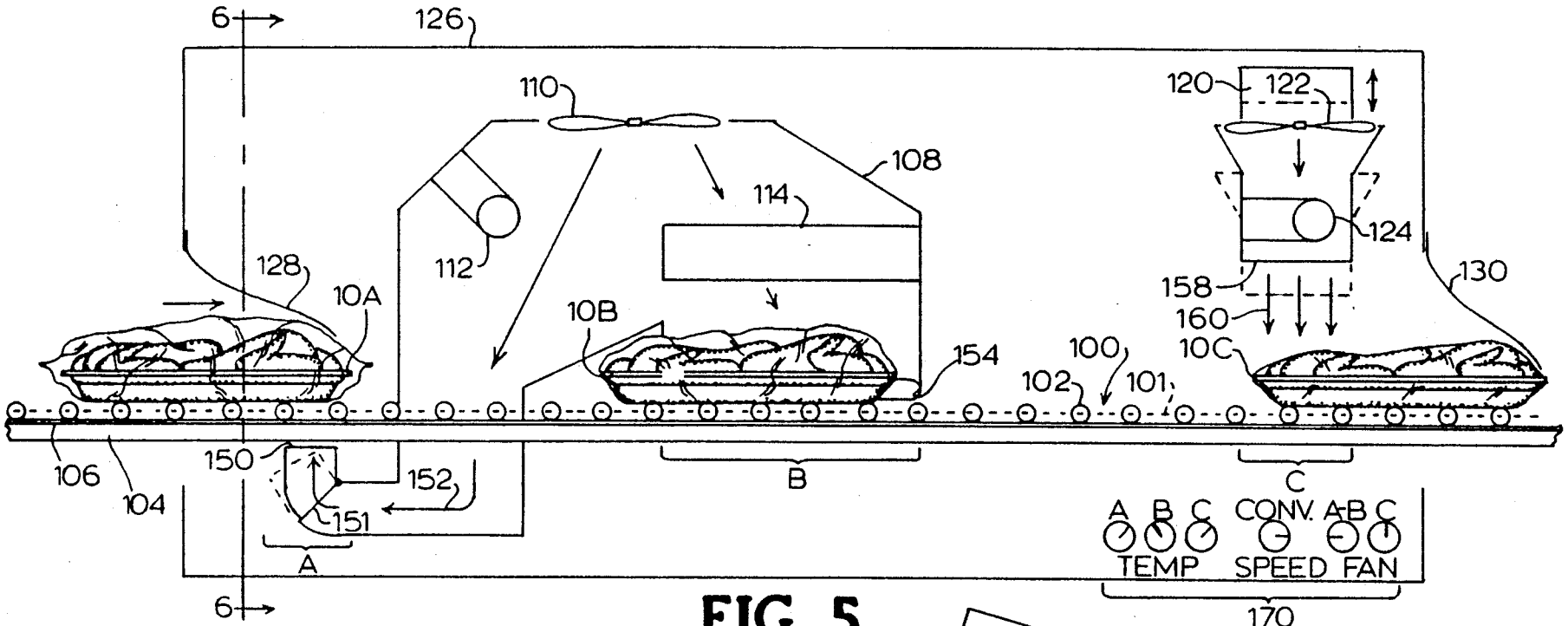
FIG. 5 is a side schematic view of the shrink tunnel including product filled trays being processed at each of the operative sequential shrink stations A, B and C.

Going from the shrink tunnel to the process it performs, FIG. 5 portrays the shrink tunnel 126 of FIG. 4 with wrapped products passing through in several stages of shrinking film 14. Illustrated by means of the wrapped tray representation at operative Stations A, B, and C in FIG. 5 and detailed tray views 7, 8, 9, 10, 11 and 12 are the effects of sequential shrinking on film wrap 14 as practiced by the present invention. At Station A of FIG. 5 film wrapped tray 10A is shown passing over upwardly directed nozzle 150 and being impinged by heated air stream 152. By the combination of the speed of travel of tray 10, typically in the range of 40–45 trays per minute and the size and the positioning of bottom nozzle 150, the air stream 152 is directed primarily to the ends of film 14, shrinking leading end first to pull leading seal 16 downwardly and inwardly to essentially draw seal 16 beneath flange 22 of tray 10A.

As tray 10A continues to pass over top nozzle 150 and is impacted by air stream 152 the heated air shrinks the film on the lower surface of tray 10 and particularly lower seam 20. At the completion of the travel of tray 10A over nozzle 150 heated air stream 152 impinges the trailing end of tray 10A and shrinks the film trailing seal 18 into a position beneath flange 22.

Figure 7:
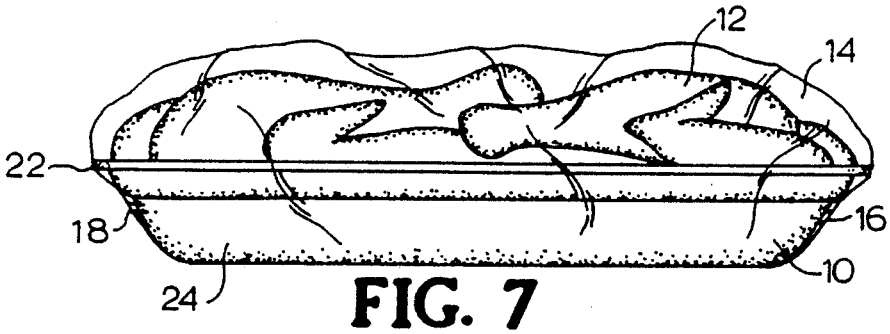
FIG. 7 is a side view of a wrapped product-filled tray after passing through shrink station A of the invention and removed to display the partial shrink accomplished.

For purposes of fully visualizing the effect of the sequential process of shrinking film 14, FIG. 7 depicts tray 10 removed from shrink tunnel 126 for illustration with film 14 partially shrunk as it appears after passing over nozzle 150 and before any further shrinking has occurred. Both end seals 16 and 18 are shrunk into positions beneath the respective ends of flange 22.

Returning to FIG. 5, tray 10B at Station B, having fully passed Station A and the first process of shrinking, is shown passing between the pair of heated air side nozzles 154 which cause opposed horizontal streams of hot air to impinge the lower sides 24 of film wrap 14 to uniformly tighten film 14 in these areas. It is to be noted that this tightening of the film 14 on the sides of tray 10 tends to further secure the seals 16, 18 below the flange 22 since the biaxial shrink film will apply tension at the mutual corners.

Figure 8:
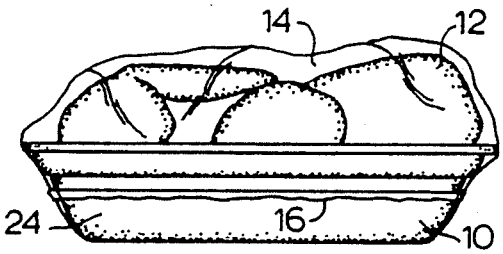
FIG. 8 is an end view of a wrapped product-filled tray after passing through shrink station A and shrink station B of the invention to display the partial shrink accomplished.

FIG. 8 follows the illustrative precedent of FIG. 7 and depicts tray 10B with film 14 partially shrunk as it appears after passing over the bottom nozzle 150 and after passing between the pair of side nozzles 154 in the shrink oven of FIG. 5. At this stage, all areas of film wrap 14 are shrunk and neatly tightened with the exception of the upper surface. Also at this stage, seals 16 and 18 will have been brought into their respective aesthetically attractive positions below flange 22 at each end of tray 10.

To complete the process in FIG. 5, tray 10C is shown at Station C after having passed stations A and B as transported by conveyor 100. At Station C, tray 10C passes immediately below a downwardly directed rectangular shaped heated air top nozzle 158. Top nozzle 158 essentially spans the width of tray 10C and discharges a substantially large volume of hot air to cover the upper surface of film 14 as the package passes rapidly beneath, achieving an aesthetically attractive result. Housing 120, including heater 124, air moving means 122 and nozzle 158 is adjustable in vertical height to accommodate various film and package conditions. Any suitable height adjusting means may be employed and is otherwise not shown in detail.

Figure 6:
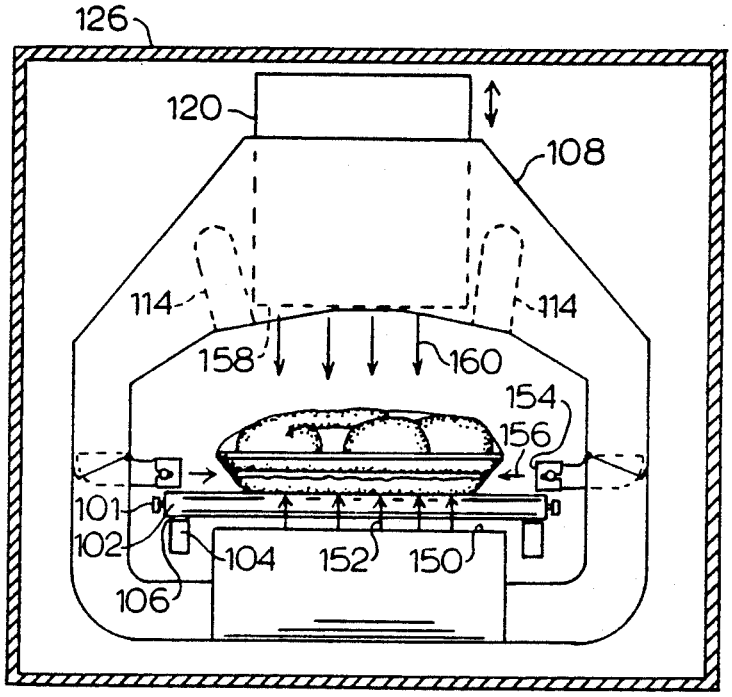
FIG. 6 is an end sectional view taken in the direction of line 6—6 of FIG. 5 illustrating the relation of the several hot air nozzles to the wrapped product.

FIG. 6 portrays a view of the nozzles and air stream flows from the entry 128 of tunnel 126 taken in the direction of line 6—6 of FIG. 5. In the first step, bottom nozzle 150 directs heated air stream 152 upwardly through conveyor 100 at the lower surface of the film wrapped tray 10, and particularly at the end seams 16 and 18, the lateral ends of the air stream 152 only slightly affecting side portions 24. Then the pair of side nozzles 154 direct heated air stream 156 laterally at the lower side portions 24 of film 14 around tray 10. Last, top nozzle 158 directs heated air stream 160 vertically downward at the top of film wrapped tray 10.

Figure 13:
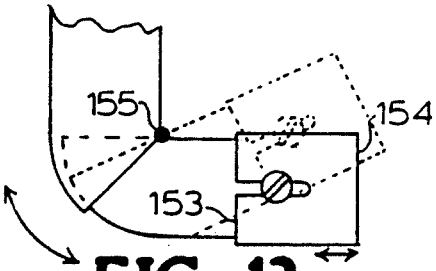
FIG. 13 shows an enlarged side view of side nozzle 154 illustrating the angular and linear adjustability thereof.

FIG. 13 illustrates an enlarged view of nozzle 154 as would apply to either side of shrink tunnel 126. To enable optimum proximity and angular placement of nozzle 154 and air flow 156, there may be added various adjustment means. Typical of the adjustments useful to this purpose would be sliding adjustment 153 with the ability to position nozzle 154 at the optimal lateral distance from package tray 10 and angular adjustment 155 with the ability to direct nozzle 154 angularly to adapt to package height and other characteristics.

FIGS. 9–12 depict tray 10 and film 14 enclosing product 12 after passing through the entire tunnel 126 on conveyor 100 including Stations A, B and C. The entire film has now been shrunk in sequence so as to control the appearance of the finished shrunk film 14. The end seals in particular are shrunk into a position beneath flange 22 of tray 10 as shown in detail by enlarged view 11. The additional factor of overall neatness and absence of wrinkles enhances the commercial acceptability thereof.

Figure 9:
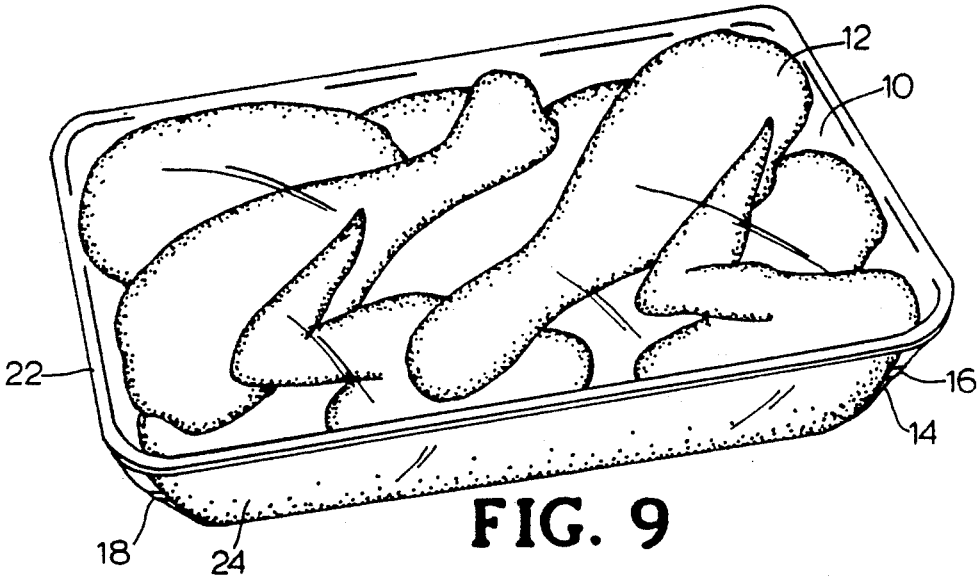
FIG. 9 is a perspective view of a wrapped product-filled tray after passing through the entire process of Stations A, B and C of the invention.
Figure 10:
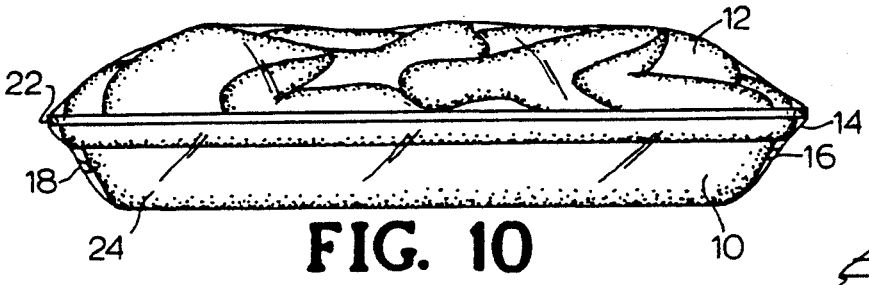
FIG. 10 is a side view of the same tray as depicted in FIG. 9 after having been fully heat shrunk.
Figure 11:
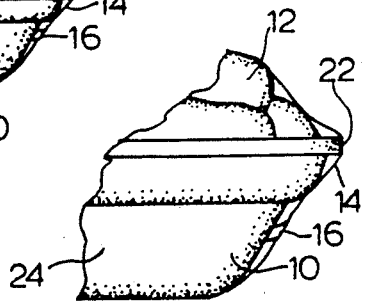
FIG. 11 is an enlarged fragmentary side view of the end of the tray of FIG. 10, depicting the end seals shrunk beneath the flanges of the tray.
Figure 12:
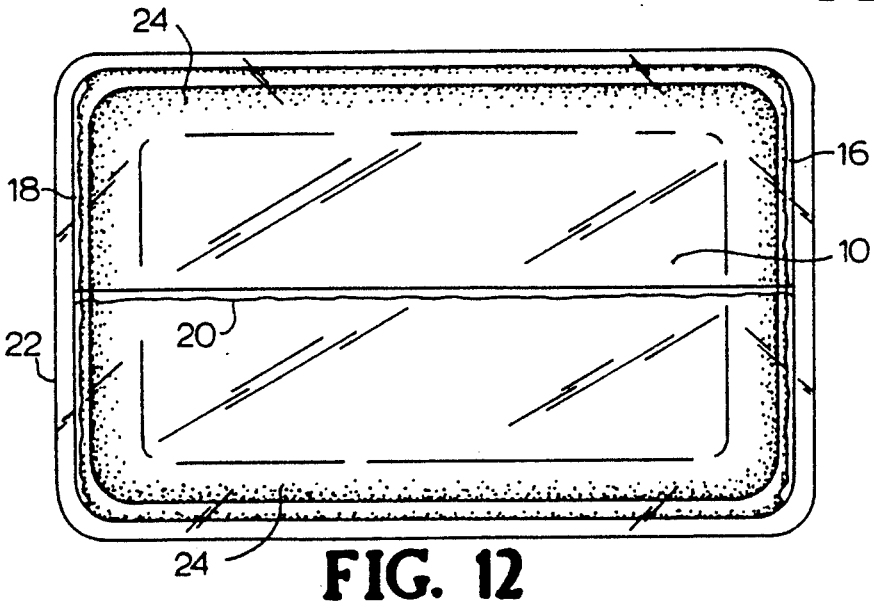
FIG. 12 is a bottom view of the same tray as depicted in FIG. 9 showing the end seals shrunk beneath the flange of the tray and showing the bottom center seam shrunk along the longitudinal center line of the bottom of the tray.

FIG. 9 is a perspective top view of completely shrunk wrapped tray 10 which is neat in overall appearance, having all portions of shrink film 14 shrunk tightly and particularly end seals 16 and 18 shrunk and drawn downwardly beneath the flange 22 of tray 10. FIG. 10 shows a side view of the tray of FIG. 9 demonstrating the overall neatness of the ends. FIG. 11 is an enlarged end view of FIG. 10 to show more clearly a typical result of the sequential shrink process on the end seal 16. FIG. 12 shows the bottom of the completely shrunk wrap and the bottom seal 20. Here the end seals 16 and 18 can be seen clearly beneath flange 22.

In the preferred embodiment of the present invention, an article wrapped in a loosely fitted film such as a polyvinylchloride or polyethylene of 0.0127-0.0381 mm (0.0005 inch - 0.0015 inch thickness, of heat shrinkable material which is sealed on the bottom along the center and at the leading and trailing ends by bar sealing, or the like, is transported through a heat shrink tunnel on a conveyor means. The conveyor, typically operating at between 15–25 meters/min. (50–80 feet per minute) velocity, is configured of a pair of chains supporting a series of spaced rubber covered metal rollers on a supporting member such that the rollers roll, allowing all areas of the film wrapped tray bottom to be impinged by heated air. Alternate means of accomplishing the goal of roller rotation and deterrence of film burning or sticking may be substituted within the spirit of the present invention.

In summary, the shallow rectangular tray passing within the tunnel first goes over an upwardly directed heated air stream, next between a pair of horizontally disposed, inwardly directed air streams aimed at the lower portion of said tray wrapper. Then the tray and film pass under a downwardly directed heated air stream. The heated air streams may operate at the range of 122–177° C. (250–350° F.) and convey a adequate volume of air adjustable to the requirements of the system. The first upwardly directed and second inwardly directed air streams flow from elongate nozzles to direct and control the shrink action. The third downwardly directed air stream flows from a substantially larger and rectangular outlet to cover the upper film completely with an adequate volume of heated air. As the directed heated air streams concentrate maximum shrink effect on the impingement sites, the warm ambient air within the tunnel shrinks the areas at a differential shrink rate. As illustrated, the package proceeding through the shrink tunnel completely clears shrink Station A before entering shrink Station B and completely clears shrink Station B before entering shrink Station C, though in practice, this condition may not always pertain.

While the principle objectives of the present invention are directed at a single sheet tubular wrapped tray, the invention could be used advantageously in the shrinking of other packaging configurations, such as, but not limited to,the double sheet sandwich wrap. The prime motivation of obtaining a neatly shrunk package with the edge seals tucked out of the main area of view will apply to a variety of applications within and beyond the meat packaging industry. Many other food items as well as dry goods and general merchandise would benefit from the invention disclosed herein.

What I claim is:

1. A shrink tunnel apparatus for the selective shrinking of a film wrapped package having a product supported in a shallow rectangular tray having a substantially flat bottom wall, upwardly and outwardly inclined side walls extending from the bottom wall and forming sides and leading and trailing ends of the tray, said side walls each having an outer peripheral lip proximate the upper end thereof and a heat shrinkable film loosely enclosing said package with the longitudinal edges thereof being sealed adjacent said bottom wall and the ends thereof being sealed across the width of the tray adjacent leading and trailing ends thereof, said shrink tunnel comprising:

(a) a tunnel having an entry and an exit each respectively closed by a flexible, passable hot air retaining flap covering for retaining hot air circulated therein;

(b) a conveyor for transporting a continuing flow of film wrapped, product filled trays through said tunnel from said entry to said exit and through hot air contained therein, said conveyor being constructed so as to permit hot air to pass therethrough;

(c) a heat generating plenum within said tunnel having a first air moving means, a first air heating means, a first elongate nozzle and a second pair of heating means second pair of elongate nozzles, said nozzles communicating with said plenum and said first nozzle being positioned beneath said conveyor near the entry of said tunnel, mounted transverse thereto and upwardly directed so that the air stream therefrom passes through said conveyor, impinges the film on the bottom of each successive said tray transported by said conveyor and is thereafter circulated to heat air in said tunnel and said second pair of nozzles being positioned downstream of said first nozzle, above and outboard of said conveyor and directed inwardly so that the air streams therefrom impinge the film covering the lower side wall areas of each successive said tray transported by said conveyor and are thereafter circulated to further heat the air in said tunnel;

(d) a housing within said tunnel having a second air moving means, a second air heating means and a substantially rectangular downwardly directed nozzle communicating with said housing, said housing being mounted downstream of said second pair of nozzles and above said conveyor so that a hot air stream from said downwardly directed nozzle impinges the film on the top of each successive said tray transported by said conveyor and is thereafter circulated to further heat the air in said tunnel; and (e) means for adjusting and controlling the respective temperatures, air flow and conveyor speed within said shrink tunnel.

2. A shrink tunnel apparatus as claimed in claim 1, wherein said conveyor is comprised of a series of rotatably mounted substantially cylindrical rollers extending between a pair of driven chains, said rollers being assembled to said chains with substantial open space enabling hot air to pass therethrough.

3. A shrink tunnel apparatus as claimed in claim 1, wherein said housing is adjustably mounted within said tunnel such that said housing may be raised or lowered to suit the product being processed.

4. A shrink tunnel apparatus as claimed in claim 1, wherein said first elongate nozzle is adapted to be angularly adjustable in direction of air stream discharge to approximately 45° either side of vertical.

5. A shrink tunnel apparatus as claimed in claim 1, wherein said second pair of inwardly directed elongate nozzles are adapted to be adjustable in direction of air stream discharge to approximately 45° either side of horizontal.

6. A shrink tunnel apparatus as claimed in claim 2, further comprising a substantially rigid member positioned to support and contact said conveyor rollers to impart a rotative motion thereto thereby imparting a forward motion relative to the conveyor to each successive said tray transported by said conveyor through said tunnel.

7. A shrink tunnel apparatus as claimed in claim 6 in which said rigid member comprises a substantially rigid support member having an attached surface layer operative to frictionally interact with said rollers, imparting a rotative motion thereto thereby imparting a forward motion relative to the conveyor to each successive said tray transported by said conveyor through said tunnel.

8. A shrink tunnel apparatus as claimed in claim 5, wherein said second pair of inwardly directed elongate nozzles are also adapted to be horizontally extendable to adjust the proximity of air stream discharge to said tray.

9. A shrink tunnel apparatus for the selective shrinking of a film wrapped package having a product supported in a shallow rectangular tray having a substantially flat bottom wall, upwardly and outwardly inclined side walls extending from the bottom wall and forming sides and leading and trailing ends of the tray, said side walls each having an outer peripheral lip proximate the upper end thereof and a heat shrinkable film loosely enclosing said package with the longitudinal edges thereof being sealed adjacent said bottom wall and the ends thereof being sealed across the width of the tray adjacent leading and trailing ends thereof, said shrink tunnel comprising:

(a) a tunnel extending between an entrance and an exit and having passable means for retaining hot air circulated therein;

(b) a continuously driven conveyor passing through the tunnel between the entrance and exit and adapted to support a continuing flow of the packages with the bottom walls thereof resting on the conveyor, said conveyor having a plurality of spaced apart rollers permitting air to pass therethrough;

(c) at a first station within the tunnel an upwardly directed first stationary source of hot air positioned for impinging hot air through the conveyor across the full width and a portion of the length of the bottom of the package while the package continues to move through said first station causing the end seals of said package to contract and assume positions below the tray lip at the ends thereof;

(d) at a second station within the tunnel located downstream from said first station horizontally opposed second stationary fixed sources of hot air and adapted while said package moves through said second station between said second sources of hot air for applying hot air toward and along lower portions of the sides of the tray to cause the film thereon to shrink;

(e) at a third station within the tunnel located downstream from said second station a third downwardly directed stationary source of hot air adapted while said package moves through said third station to force hot air from said third source of hot air on the top surface of said package to complete the shrinkage of the film enclosing the package; and (f) at said first, second and third stations within said shrink tunnel the respective air streams after having impinged and passed the film wrapped package circulate within said tunnel, retained therewithin by entry and exit flaps, maintaining a warm atmosphere which acts to shrink said film at a slower rate than that caused by said impinging hot air sources.

10. A shrink tunnel apparatus as claimed in claim 9 wherein said first, second and third stations are spaced apart sufficiently to permit the shrinking action of each sequential station to be separated from the shrinking action of the next sequential station.

11. A shrink tunnel apparatus as claimed in claim 9 wherein said conveyor rollers support said flow of packages with the bottom walls thereof resting on said rollers and including means supporting said conveyor rollers and operative to rotate said rollers wherey to cause each successive said tray transported by said conveyor to move both with and relative to said conveyor.

12. A process for the selective shrinking of a film wrapped package having a product supported in a shallow rectangular tray having a substantially flat bottom wall, upwardly and outwardly inclined walls extending from said bottom wall and forming sides and leading and trailing ends, said sides and ends each having a peripheral lip proximate the upper end thereof and a heat shrinkable film loosely enclosing said package with the longitudinal edges thereof being sealed adjacent said bottom wall and the ends thereof being sealed across the width of the tray adjacent leading and trailing ends thereof; comprising:

(a) continuously conveying a series of said film wrapped packages through a shrink tunnel with the bottom walls of the packages supported on spaced apart rollers in a moving conveyor passing through the tunnel between an entrance and an exit;

(b) at a first station within the tunnel continuously applying from a stationary lower source of hot air located below the conveyor a stream of hot air directed through the conveyor across the full width and a portion of the length of the bottom of each successive package while the package continues to move through said first station whereby to cause the end seals of each successive said package to contract and assume positions below the tray lip at the ends thereof and other portions of the film primarily on the bottom of the package to also shrink;

(c) at a second station within the tunnel located downstream from said first station conveying said package between stationary horizontally opposed side sources of hot air and while each successive said package continues to move through said second station applying streams of hot air from said side sources of hot air toward and along a lower portion of both sides of the tray in each successive package to cause the film thereon to shrink; and (d) at a third station within the tunnel located downstream from said second station conveying each successive said package below a downwardly directed fixed upper source of hot air and while each said successive package continues to move through said third station applying a stream of hot air from said upper source of air so as to impinge on the top of each successive said package to complete the shrinkage of said film on said package.

13. A process as claimed in claim 12 further comprising, exposing sections of said heat shrinkable film which are not contemporaneously impinged by directed heated air steams to warm ambient non-directed air within said tunnel effecting differential shrinkage between said impinged areas and said non-impinged areas.

14. A shrink tunnel apparatus for the shrinking of a heat shrinkable film formed as an enclosure with a sealed seam across a bottom surface and a sealed seam across two ends perpendicular to said bottom seam, within the enclosure a product supported in a shallow rectangular tray having a substantially flat bottom wall with upwardly and outwardly inclined walls being sides and leading and trailing ends, said walls each having an outwardly protruding peripheral flange adjacent the upper end of said walls, comprising:

(a) a tunnel housing having entry and exit openings, each being flexibly closed by a passable flap;

(b) a conveyor passing through said shrink tunnel housing, said conveyor adapted to transport a succession of said film enclosed trays continuously in a direction from said entry to said exit;

(c) a first shrink station within said shrink tunnel housing having an elongate source of heated air directed upward from beneath said conveyor at the lower surface of each successive said tray and being disposed transverse to the travel path of said conveyor so as to essentially cover the entire width and a portion of the length of each successive said package and adapted to shrink said film such that said end seams are drawn beneath said flanges at the leading and trailing ends of each successive said package;

(d) a second shrink station within said shrink tunnel housing having a pair of elongate sources of heated air horizontally opposed and directed laterally at the lower sides of each successive said tray on said conveyor said pair of elongate heat sources having discharge openings residing in planes disposed parallel to the travel path of said conveyor and being operative to shrink said film such that the lower side portions pull downwardly and inwardly on each successive said tray; and (e) a third shrink station within said shrink tunnel housing having a source of heated air directed downward through a substantially rectangular shaped nozzle from above said conveyor at the upper surface of said film covering each successive said tray such that said upper surface is tightened and smoothed.

15. A process for the shrinking of a heat shrinkable film forming a package enclosing a product supported in a shallow rectangular tray with a peripheral upper flange, said film being sealed across leading and trailing ends of said tray, comprising:

(a) transporting said film wrapped package on a conveyor through a shrink tunnel having three operative sequential stations capable of applying directed streams of heated air to packages passing thereby;

(b) blowing a heated air stream at a first station from beneath and through said conveyor upwardly at a bottom surface of said package and particularly at the leading and trailing end seals thereof such that said end seals are drawn beneath said tray flange;

(c) blowing a pair of horizontally opposed heated air streams at a second station from beside said conveyor laterally at both lower sides of said package such that said side film is tightened in the lower portion; and (d) blowing a heated air stream at a third station from above said conveyor downwardly at a top surface of said package such that the entire film enclosure is tightened and essentially free of wrinkles with said end seals drawn beneath said peripheral flange.

16. A process as claimed in claim 15 further comprising, exposing sections of said heat shrinkable film which are not contemporaneously impinged by directed heated air streams to warm ambient non-directed air within said tunnel effecting differential shrinkage between said impinged areas and said non-impinged areas.

17. A process as claimed in claim 15 in which said conveyor comprises a pair of driven chains with a series of substantially cylindrical rollers mounted therebetween with spacing between said successive rollers to allow an adequate flow of air to the bottom portion of said package.

18. A process as claimed in claim 17 further comprising one or more elongate support members disposed to contact said rollers and cause rotation thereof, causing said packages to move forward relative to the travel of the conveyor.

19. An apparatus for the sequential shrinking of a package consisting of heat shrinkable film enclosing a flanged tray containing a product such that seals at a leading and a trailing end of said film are drawn beneath flanges of said tray, comprising:

(a) transporting means for moving said wrapped packages along a predetermined path past three heat application stations;

(b) lower first station heating means adapted to apply heat to only a lower portion of said wrapped package as said package passes over said heating means, moving along said path;

(c) lateral second station heating means positioned downstream along said predetermined path in relation to said lower heating means adapted to apply heat to only a lower lateral portion of each side of said package as said package passes between said lateral heating means; and (d) upper third station heating means positioned downstream along said predetermined path in relation to said lateral heating means adapted to apply heat to only an upper portion of said wrapped package as said package passes beneath said upper heating means.

20. An apparatus as claimed in claim 19 in which said lower heating means is an upwardly directed elongate nozzle oriented perpendicular to said predetermined path, positioned to impinge a heated air stream at the bottom of said film wrapped package and particularly to impinge a leading end and a trailing end thereof.

21. An apparatus as claimed in claim 19 in which said lateral heating means is a pair of horizontally opposed elongate nozzles operative to direct streams of hot air oriented perpendicular to said predetermined path and directed so as to impinge the lower sides of said film wrapped package.

22. An apparatus as claimed in claim 21 in which said transporting means is a conveyor.

23. An apparatus as claimed in claim 22 in which said conveyor comprises:

(a) a pair of driven chains;

(b) a series of substantially cylindrical, thermally insulating rollers supported on said pair of chains such that said rollers are able to rotate; and (c) one or more friction members mounted to contact the surface of said rollers such that said rollers rotate as they are moved by said chains.

24. An apparatus as claimed in claim 23 in which said friction enhancing members comprise:

(a) one or more support members; and (b) a thin surface member mounted on said one or more support members to contact the surface of said rollers such that said rollers rotate.

25. An apparatus as claimed in claim 24 further comprising controlling means to regulate heat air volume and conveyor speed within said apparatus.

* * * * *